US006083888A

United States Patent [19]

Sutherland

[11] Patent Number: 6,083,888

[45] Date of Patent: Jul. 4, 2000

[54] DISPERSANT VISCOSITY INDEX IMPROVERS

[75] Inventor: Robert Jude Sutherland, Houston, Tex.

[73] Assignee: Shell Oil Company, Houston, Tex.

[21] Appl. No.: 08/931,177

[22] Filed: Sep. 16, 1997

Related U.S. Application Data

[60] Provisional application No. 60/026,904, Sep. 24, 1996, and provisional application No. 60/054,227, Jul. 29, 1997.

[51] Int. Cl.[7] ..... C10M 149/10

[52] U.S. Cl. ..... 508/221; 508/543; 525/279; 525/280; 525/281; 525/282; 525/293

[58] Field of Search ..... 508/269, 221, 508/543; 525/279–282, 293

[56] References Cited

U.S. PATENT DOCUMENTS

| | | | |
|---|---|---|---|
| 4,085,055 | 4/1978 | Durand et al. | 252/50 |
| 4,092,255 | 5/1978 | Chapelet et al. | 252/30 |
| 4,136,048 | 1/1979 | Staples | 508/491 |
| 4,146,489 | 3/1979 | Stambaugh et al. | 252/50 |
| 4,160,739 | 7/1979 | Stambaugh et al. | 252/34 |
| 4,281,081 | 7/1981 | Jost et al. | 525/281 |
| 4,282,132 | 8/1981 | Benda et al. | 508/269 |
| 4,358,565 | 11/1982 | Eckert . | |
| 4,670,173 | 6/1987 | Hayashi et al. | 252/51.5 A |
| 4,693,838 | 9/1987 | Vrma et al. | 252/51.5 R |
| 4,780,228 | 10/1988 | Gardiner et al. | 252/51 |
| 4,816,172 | 3/1989 | Kapuscinski et al. | 252/47 |
| 4,820,776 | 4/1989 | Kapuscinski et al. | 525/279 |
| 4,863,623 | 9/1989 | Nalesnik | 508/269 |
| 4,877,415 | 10/1989 | Kapuscinski et al. | 44/62 |
| 4,886,611 | 12/1989 | Kapuscinski et al. | 252/47 |
| 4,922,045 | 5/1990 | White et al. | 585/10 |
| 4,952,637 | 8/1990 | Kapuscinski et al. | 525/279 |
| 5,035,820 | 7/1991 | Rhodes et al. | 252/50 |
| 5,061,751 | 10/1991 | Patton | 525/57 |
| 5,294,354 | 3/1994 | Papke et al. | 252/18 |
| 5,298,565 | 3/1994 | Lange et al. | 508/269 |
| 5,429,758 | 7/1995 | Hayashi et al. | 252/56 R |
| 5,523,008 | 6/1996 | Boden et al. | 252/50 |
| 5,663,126 | 9/1997 | Boden et al. | 508/221 |

FOREIGN PATENT DOCUMENTS

| | | | |
|---|---|---|---|
| 199453 | 10/1998 | European Pat. Off. . | |
| 302239 | 10/1998 | European Pat. Off. . | |
| 377240 | 10/1998 | European Pat. Off. . | |
| 1558991 | 7/1975 | United Kingdom | C08F 255/02 |

*Primary Examiner*—Jacqueline V. Howard

[57] ABSTRACT

A lubricating oil composition comprising:

(a) from 0.01 to 10 percent by weight of a dispersant viscosity index improver linear diblock copolymer or a radial or star copolymer with each arm having an overall number average molecular weight of 7500 to 250,000 and comprising a block of a conjugated diene having a number average molecular weight of 5000 to 200,000 and a block of a vinyl aromatic hydrocarbon having a number average molecular weight of 2500 to 100,000, and a vinyl aromatic hydrocarbon content of 5 to 50 weight percent, wherein from 5 to 10 N-vinyl imidazole functional groups per molecule have been grafted onto the copolymer;

(b) from 5 to 20 percent by weight of a dispersant inhibitor package containing 40 percent by weight less ashless dispersant than is required for use with a non-dispersant viscosity index improver; and (c) from 80 to 95 percent by weight of a base oil.

28 Claims, No Drawings

DISPERSANT VISCOSITY INDEX IMPROVERS

CROSSREFERENCE TO PRIOR APPLICATIONS

This application claims the benefit of U.S. Provisional application No. 60/026,904, filed Sep. 24, 1996 and No. 60/054,227, filed Jul. 29, 1997.

FIELD OF THE INVENTION

This invention relates to dispersant viscosity index improvers for lubricating oils, especially motor oils. More particularly, this invention relates to dispersant viscosity index improvers made from styrene/hydrogenated diene block copolymers.

BACKGROUND OF THE INVENTION

Lubricating oils for use in crankcase engine oils contain components which are used to improve the viscometric performance of the engine oil, i.e., to provide for multigrade engine oils, such as SAE 5W-30, 10W-30, and 10W-40, etc. These viscosity performance enhancers, commonly referred to as viscosity index (VI) improvers, include olefin copolymers, polymethacrylates, and styrene/hydrogenated diene block and star copolymers. These materials are often called nondispersant VI improvers because they do not help prevent varnish or sludge in the oil from depositing on the inside of an internal combustion engine.

To prevent this sludge from depositing on the engine parts, dispersants, commonly referred to as ashless dispersants, are added to the motor oil. These dispersants keep the sludge and varnish materials suspended in the oil and prevent them from forming deposits in the engine. The current industry standard test for engine cleanliness is the ASTM Sequence VE test (measuring sludge, varnish, and wear in the engine). For an ashless dispersant to be considered effective, it must allow a motor oil formulated with a nondispersant VI improver to pass this test while passing the industry standard ASTM Sequence VIA fuel economy test as well as other tests required by the industry. Generally, the fuel economy suffers as more ashless dispersant is added to the motor oil. A dispersant VI improver can replace ashless dispersant and still maintain good engine cleanliness in the Sequence VE test. In addition, it will give better fuel economy in the Sequence VIA fuel economy test.

It is therefore an objective of this invention to provide a lubricating oil dispersant viscosity index improver which is highly effective and able to replace a substantial amount of the ashless dispersant additive normally used in an engine oil. This invention describes such a dispersant VI improver and a process for its preparation.

For instance, a typical crankcase engine oil composition contains from about 80 to 95 percent by weight of base oil, 0.1 to 3 a percent of a viscosity index improver (VII), and from 5 to 20 percent of a dispersant inhibitor (DI) package which contains an ashless dispersant. The viscosity index improver described herein is a non-dispersant VII. This is the reason that the ashless dispersant is required in this composition. The active components of the DI package normally contains about 50 to 60 percent by weight (% wt) of the ashless dispersant, the balance being comprised of other ingredients such as a detergent, an anti-wear agent, an antioxidant and various other minor additives. The oil compositions using the dispersant viscosity index improvers (DVII) of the present invention will still contain about 80 to 95 percent of the base oil and from 0.1 to 3 percent of the dispersant viscosity index improver which may be entirely made up of the novel DVII of the present invention or may be a mix of said DVII with a non-dispersant viscosity index improver.

The DI package will still comprise from about 5 to 20 percent by weight of the crankcase oil composition. However, it will be shown below that equivalent performance to the performance of the prior art typical oil composition can be achieved with the oil composition of the present invention wherein the DI package contains from 0 to 60 percent of the amount of ashless dispersant used in the DI package of the prior art typical oil composition. Thus, the present invention allows the amount of ashless dispersant to be reduced by at least 40 percent compared to the amount needed with a non-dispersant viscosity index improver, i.e., the typical oil composition described above.

SUMMARY OF THE INVENTION

This invention provides a dispersant viscosity index improver which is, in its preferred embodiment, a linear diblock copolymer comprising a block of a hydrogenated conjugated diene and a block of a vinyl aromatic hydrocarbon, preferably isoprene and styrene, to which N-vinylimidazole has been grafted. The grafted copolymers contain from 5 to 10 grafted N-vinylimidazole (NVI) functional groups per polymer molecule, preferably an average of 7 to 8 NVI functional groups per polymer chain. These diblock copolymers can form the arms of radial or star block copolymers which are also within the scope of this invention.

The vinyl aromatic hydrocarbon content of these copolymers generally ranges from 5 to 50 percent by weight (wt %). The overall number average molecular weight of the diblock copolymers may range from 7,500 to 250,000. The number average molecular weight of the diene block ranges from 5,000 to 200,000 and the number average molecular weight of the vinyl aromatic hydrocarbon block ranges from 2,500 to 100,000. If these diblocks form arms of a radial or star copolymer, the overall molecular weight of the radial or star copolymer will, of course, be much higher.

Fully formulated lubricating oil compositions of the present invention generally comprise from 0.01 to 10% wt of the dispersant viscosity index improver copolymer described in the preceding paragraph, 80 to 95% wt of the lubricating oil, and 5 to 20% wt of a modified dispersant inhibitor additive package containing a reduced amount of ashless dispersant. The preferred amount of the dispersant VII is from 0.1 to 8% wt and the most preferred range is 0.1 to 3% wt.

DETAILED DESCRIPTION OF THE INVENTION

The base polymers suitable for functionalization by the process of this invention and thus to be used as DVII (or without functionalization as non-dispersant VII) include hydrogenated copolymers of one or more conjugated diolefins containing from 4 to 12 carbon atoms and one or more monoalkenyl aromatic hydrocarbons containing from 8 to about 16 carbon atoms and the like. The base polymer may have a linear or radial architecture or may be a mixture of such polymers. The polymers may be hydrogenated selectively, completely or partially, preferably to the extent that greater than 90% of the initial ethylenic unsaturation is removed by hydrogenation. Preferably, the hydrogenated polymers are substantially free of ethylenic unsaturation.

Selective hydrogenation refers to processes which hydrogenate a substantial portion of the ethylenic unsaturation but leave a substantial portion of the initial aromatic unsaturation unhydrogenated. As used herein, a hydrocarbon polymer substantially free of ethylenic unsaturation will be a hydrocarbon polymer containing, on average, less than about 10 carbon-carbon ethylenic double bonds per polymer chain. Polymers containing more than this amount of ethylenic unsaturation will, under certain conditions, exhibit excessive crosslinking during a functionalization reaction when the functionalization is completed in a blending apparatus capable of imparting high mechanical shear.

Useful hydrocarbon polymers include those prepared in bulk, suspension, solution or emulsion. As is well known, polymerization of monomers to produce hydrocarbon polymers may be accomplished using free-radical, cationic, and anionic initiators or other polymerization catalysts, such as transition metal catalysts used for Ziegler-Natta and metallocene type catalysts.

Oil Compositions

The lubricating oil compositions of the present invention contain from 80 to 95% wt of one or more base oils, from 0.01 to 10% wt of the dispersant viscosity index improver block copolymer of this invention, and from 5 to 20% wt of the modified DI additive package which contains a reduced amount of ashless dispersant as compared to the amount of ashless dispersant used in current commercial lubricating oil compositions of this type. The preferred amount of DVII is from 0.1 to 8 percent weight and such compositions will normally contain from 0.1 to 5% wt. The most preferred range for use herein is 0.1 to 3% wt because with less than 0.1% wt, the DVII will contribute too little dispersancy and with more than 3% wt, the DVII will thicken the motor oil too much to give the best viscometric properties.

The dispersant inhibitor package normally contains an ashless dispersant which is present to keep the precursors of sludge and varnish from forming deposits in the engine. Other typical components of the DI package are detergents, anti-wear agents, antioxidants, and various other minor additives. Examples of the typical components of a DI package are given in U.S. Pat. No. 5,512,192, which is herein incorporated by reference, in columns 27 to 31.

As discussed above, it is an important aspect of this invention that the presence of the dispersant viscosity index improver of the present invention permits the use of lesser amounts of ashless dispersant in the engine oil composition. Since the ashless dispersant generally has a negative effect on the fuel economy, it is a distinct advantage to be able to achieve the same level of sludge and varnish prevention while using less of the ashless dispersant. According to the present invention, the amount of ashless dispersant can be reduced by at least 40 percent as compared to the amount which is required by typical commercial compositions based on a non-dispersant VII. The reduction in ashless dispersant content of the formulated oil provides the oil formulator the ability to use less volatile base oil mixtures due to reductions in the low-temperature, high-shear-rate viscosity (ASTM D-5293). The use of lower volatility base oils is important as volatility requirements for formulated oils are expected to become more restrictive in the future.

The block copolymers which are being functionalized in this invention have long been used in lubricating oil compositions as non-dispersant viscosity index improvers. When one of these polymers is replaced by its NVI-functionalized equivalent, the amount of ashless dispersant in the DI package can be decreased by at least 40 percent or more depending upon the amount of DVII which is used in the oil composition. As an example, consider a typical oil composition which could contain 92% wt oil, 1% wt of the unfunctionalized diblock polymer described herein, and 7% wt of a DI package which contains 57% wt of the ashless dispersant (i.e., the total amount of ashless dispersant in the oil composition is 4% wt). If the VII in that composition is replaced by an equivalent amount of DVII according to the present invention, then the amount of ashless dispersant in the total oil composition can be reduced to 2.4% wt or less.

Any of the ashless dispersants which are normally used in lubricating oil compositions of this type can be used in the present invention. Typically, these ashless dispersants are relatively low molecular weight polyolefins which have been functionalized by chlorination or maleation with or without subsequent condensations being done through the succinic anhydride. Typical polyolefins used are ethylene copolymers, polybutenes ,and polyisobutylenes having a number average molecular weight between about 500 and 5000. The succinic anhydride derivative of the polyolefin can be made from the chlorinated polyolefin or via a peroxide grafting reaction. Typical further derivitization reactions are esterification with polyhydric alcohols, such as pentaerithritol, or amidization with polyamines, such as polyethylene polyamines. Such ashless dispersants are described in detail in U.S. Pat. No. 5,512,192 which is incorporated herein by reference.

Also included in these oil compositions are detergents, antioxidants, antiwear agents, rust and corrosion inhibitors, and other additives known in the art. Such materials are described generally in U.S. Pat. No. 5,567,344 which is hereby incorporated by reference. The main component of the composition of the present invention, generally from 80 to 95% wt, is the base oil for the lubricating oil composition. A wide variety of petroleum and synthetic base oils can be used herein including those described in U.S. Pat. No. 5,567,344 which is herein incorporated by reference.

Dispersant VI Improvers

The dispersant viscosity index improvers of this invention are diblock polymers of a conjugated diene and a vinyl aromatic hydrocarbon. The diblock polymers can be used as diblocks or they can be coupled into radial or star polymers. The preferred diene is isoprene and the preferred vinyl aromatic hydrocarbon is styrene. The diblock copolymers have NVI functional groups grafted thereto which provide the advantages of this invention described above.

It is important that the copolymer have from 5 to 10 NVI functional groups per polymer chain. Preferably, there should be an average of 7 to 8. If there are less than 5 NVI grafts per polymer chain, then the dispersant activity is insufficient to provide acceptable engine performance when formulated into an oil containing a DI package having a reduced ashless dispersant content. Since a level of 7 to 8 NVI grafts per polymer chain is high enough to provide good dispersancy, there is no need to go to the expense of grafting more than 10 NVI functional groups per polymer chain.. Use of more NVI than that can cause an unacceptable level of polymer degradation and/or crosslinking because of the increased amount of peroxide grafting agent which would be necessary to add more than 10 grafts of NVI per polymer chain. If the level of degradation is too high, the rheological properties of the oil composition will be adversely affected. Thus, it is found that utilization of an average of 7 to 8 NVI grafts per polymer chain provides the best combination of cost, Theological properties, and dispersant activity in an engine oil formulated with a reduced amount of ashless dispersant.

The vinyl aromatic hydrocarbon content of these copolymers which will be functionalized in this invention generally ranges from 5 to 50% wt, preferably from 20 to 40% wt. The overall number average molecular of the linear copolymers or the arms of radial or star copolymers may range from 7,500 to 250,000, preferably from 70,000 to 130,000. The number average molecular weight of the diene block ranges from 5,000 to 200,000, preferably 40,000 to 80,000, and the number average molecular weight of the vinyl aromatic hydrocarbon block ranges from 2,500 to 100,000, preferably from 20,000 to 50,000.

The minimum molecular weights of the block copolymers preferred for functionalization according to the method of the present invention are limited by the molecular weight necessary for the particular copolymer to be a solid at room temperature and atmospheric pressure. Normally liquid polymers, i.e., polymers which are liquid at standard temperature and pressure do not process well in blending equipment capable of imparting high mechanical energy such as an extruder. As a result, polymers having a molecular weight sufficiently high to be solid at standard temperatures and pressures will, generally, be used in the method of this invention. Moreover, it should be noted that chemical, thermal, and shear degradation which occurs in the blending apparatus increases with increasing molecular weight of the polymer. The amount of degradation is significantly reduced with the method of this invention and, as a result, the method of this invention may be practiced with higher molecular weight polymers than has been practicable in the extruder processing of the prior art. Generally, however, the method of this invention will not be used with polymers having a sufficiently large molecular weight as to result in more than about 30% degradation of the polymer during the extruder grafting process.

A non-dispersant VII may optionally be included in the oil composition of this invention. It will generally be present in an amount equal to or less than the amount of the DVII used. The optional non-dispersant VII portion of the compositions of the present invention can be olefin copolymers, metallocene polymers, polymethacrylate, or polymers of hydrogenated dienes and/or copolymers thereof with vinyl amines, but are preferably homopolymers of hydrogenated conjugated dienes or copolymers thereof with vinyl aromatic hydrocarbons. A wide range of molecular weight polymers of the latter type can be utilized as the base polymer of the non-dispersant VII which are used in the compositions of the present invention. Polymers which are preferred as the non-dispersant VII polymer of the present invention include the hydrogenated derivatives of homopolymers and copolymers such as are described in U.S. Pat. Nos. 3,135,716; 3,150,209; 3,496,154; 3,498,960; 4,145,298 and 4,238,202 which are incorporated herein by reference. Polymers useful in the method of present invention as the non-dispersant VII base polymer also include hydrogenated and selectively hydrogenated derivatives of block copolymers such as are taught, for example in U.S. Pat. Nos. 3,231,635; 3,265,765; 3,322,856 and 3,772,196, which are incorporated herein by reference. Polymers which are acceptable as the base polymer further include hydrogenated and selectively hydrogenated derivatives of star-shaped polymers such as are taught, for example, in U.S. Pat. Nos. 4,033,888; 4,077,893; 4,141,847; 4,391,949 and 4,444,953, which are incorporated herein by reference.

In general, number average molecular weights for the non-dispersant VII base polymer of between about 200,000 and about 3,000,000 are acceptable when the base polymer is a star-configuration hydrogenated polymer of one or more conjugated olefins or a star configuration polymer of one or more alpha olefins. For base polymers which are linear copolymers containing more than about 15% wt of monoalkenyl arenes, number average molecular weights between about 80,000 and about 150,000 are acceptable. When the non-dispersant VII base polymer is a star configuration copolymer containing more than about 3% wt of monoalkenyl arenes, the molecular weights are preferably between about 300,000 and about 1,500,000.

The non-dispersant VII polymers, as well as the dispersant VII copolymers, prepared with diolefins will contain ethylenic unsaturation, and such polymers will be hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 which are incorporated herein by reference, or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and Re 27,145 which are incorporated herein by reference. Any of these methods could also be used to hydrogenate polymers which contain only ethylenic unsaturation and which are free of aromatic unsaturation.

The number average molecular weights, as used herein for all linear anionic polymers refer to the number average molecular weight as measured by Gel Permeation Chromatograph (GPC) with a polystyrene standard. For star polymers, the number average molecular weights are determined by the same method or by light scattering techniques.

The molecular weights of linear polymers or unassembled linear segments of polymers such as mono-, di-, triblock, etc., or arms of radial or star polymers before coupling are conveniently measured by GPC, where the GPC system has been appropriately calibrated. For anionically polymerized linear polymers, the polymer is essentially monodisperse (weight average molecular weight/number average molecular weight ratio approaches unity), and it is both convenient and adequately descriptive to report the "peak" (sometimes referred to as "apparent") molecular weight of the narrow molecular weight distribution observed. Usually, the peak value is between the number and the weight average. The peak (or apparent) molecular weight is the molecular weight of the main species shown on the chromatograph. For polydisperse polymers the weight average molecular weight should be calculated from the chromatograph and used. For materials to be used in the columns of the GPC, styrene-divinyl benzene gels or silica gels are commonly used and are excellent materials. Tetrahydrofuran is an excellent solvent for polymers of the type described herein. A refractive index detector may be used.

Measurement of the true molecular weight of the final coupled radial or star polymer is not as straightforward or as easy to make using GPC. This is because the radial or star shaped molecules do not separate and elute through the packed GPC columns in the same manner as do the linear polymers used for the calibration, and, hence, the time of arrival at a UV or refractive index detector is not a good indicator of the molecular weight. A good method to use for a radial or star polymer is to measure the weight average molecular weight by light scattering techniques. The sample is dissolved in a suitable solvent at a concentration less than 1.0 gram of sample per 100 milliliters of solvent and filtered using a syringe and porous membrane filters of less than 0.5 microns pore size directly into the light scattering cell. The light scattering measurements are performed as a function of scattering angle and of polymer concentration using standard procedures. The differential refractive index (DRI) of the sample is measured at the same wavelength and in the same solvent used for the light scattering. The following references are herein incorporated by reference:

1. *Modern Size-Exclusion Liquid Chromatography,* W. W. Yau, J. J.
   Kirkland, D. D. Bly, John Wiley & Sons, New York, N.Y., 1979.
2. *Light Scattering from Polymer Solution,* M. B. Huglin, ed., Academic Press, New York, N.Y., 1972.
3. W. Kaye and A. J. Havlik, *Applied Optics,* 12, 541 (1973).
4. M. L. McConnell, *American Laboratory,* 63, May, 1978.

NVI Grafting Method

The grafting process of the present invention is preferably carried out using neat polymer in an extruder. The polymer feed consisting of one or more polymers is introduced into the initial feed port of the extruder. Optionally, a small amount of diluent oil may be introduced with the polymer or at any other point in the extruder. The NVI is introduced into the extruder downstream of the polymer feed. The NVI may be introduced neat or in solution in some organic solvent. If additional oil is required, it can be added subsequent to the introduction of the NVI. A peroxide catalyst is then added to the extruder to initiate the grafting of the NVI onto the polymer. The peroxide may be added neat or in solution in oil. The reaction then proceeds while the materials are being heated and mixed in the extruder. There is usually a vacuum vent at the end of the extruder where unreacted materials and byproducts are removed from the polymer before it exits the extruder. After the grafted polymer exits the extruder, it is then processed for finishing activities such as dusting with antioxidants or blending with other VII polymers.

If desired, the dispersant VII copolymer being modified in the method of this invention may be diluted with any suitable liquid hydrocarbon. A liquid hydrocarbon will be a suitable diluent if it is compatible with polyolefin polymers but not compatible with aromatic hydrocarbon polymers. Such a diluent would tend to swell the olefin monomer portion of the polymer without affecting the aromatic hydrocarbon monomer portion of the polymer when the polymer contains an aromatic portion. The liquid hydrocarbon may be a pure compound but generally will be a blend of compounds such as would be contained in a petroleum distillate fraction. It is however, important that the diluent remain liquid throughout the processing. It is, therefore, important that the diluent have a boiling point above the maximum temperature that will be encountered during the processing steps. Preferably, the diluent will be a neutral petroleum distillate fraction boiling generally in the fuel oil and/or lubricating oil boiling ranges. Most preferably, the diluent will have a specific gravity of about 0.9, an ASTM IBP of about 710° F. and an ASTM 90% boiling point of about 865° F. Low aromatic and non-aromatic processing oils are generally preferred. SHELLFLEX® 371 oil, a processing oil available from Shell Oil Company, Houston, Tex., is an example of a preferred processing oil. The diluent oil may be present in an amount between about 0% and about 15% by weight based on the copolymer.

Nitrogen functionality is imparted into the copolymer by contacting the copolymer in an extruder with N-vinylimidazole. In general, a sufficient amount of N-vinylimidazole will be combined with the polymer to incorporate from about 5 to about 10 functional groups, on average, per polymer chain. In this regard, it should be noted that the reaction will not proceed to completion. As a result, the amount of N-vinylimidazole reagent actually used will, generally, exceed the amount which is desired to be grafted to the copolymer by from about 10 to about 50%.

Any of the free radical initiators known in the prior art to be effective in a grafting reaction of the type herein contemplated can be used as the free radical initiator in the method of this invention. Suitable free radical initiators include the various organic peroxides and hydroperoxides as well as the various organic azo compounds. Typical organic peroxides include benzoyl peroxide, t-butyl peroxypivalate, 2,4-dichlorobenzoyl peroxide, decanoylperoxide, propionyl peroxide, hydroxyheptyl peroxide, cyclohexanone peroxide, t-butylperbenzoate, dicumyl peroxide, lauroyl peroxide and the like. Typical hydroperoxides include t-butyl hydroperoxide and 2,5-dimethyl-2,5-di(t-butylperoxy)hexane. Typical organic azo initiators include 2,2-azobis(2-methylpropionitrile), 2,2-azobis(2-methylvaleronitrile), 4,4'-azobis(4-cyanovaleric acid) and the like. In general, the free radical initiator will be used in a concentration within the range from about 0.05 to about 0.50 wt % based on polymer. Particularly preferred free radical initiators include di t-butylperoxide; 1,1-bis(t-butylperoxy) 3,3,5-trimethylcyclohexane; t-butyl cumyl peroxide and 2,5-dimethyl-2,5-di(t-butylperoxy) hexane.

The copolymer, optional diluent, N-vinylimidazole, and free radical initiator will be contacted at a temperature and pressure sufficient to insure that both the copolymer and the N-vinylimidazole are in the liquid or molten phase when the reaction occurs. The reactants will be contacted in a blending device capable of imparting high mechanical energy such as an extruder, a Banbury mixer, a sigma blade mixer and the like. These devices are referred to herein as extruders.

In the reaction step, it is much preferred that the reaction take place in the absence of oxygen. A nitrogen blanket is often used to accomplish this result. The reason for performing the reaction in the absence of oxygen is that the resulting additive may be more oxidatively unstable if any oxygen is present during the formation of the additive.

In general, and in the method of this invention, the extruder temperature may range from about 160° C. to about 250° C., depending upon the particular copolymer being processed, while the reaction between the copolymer and the N-vinylimidazole takes place. Variation of the temperature in the different stages of the extruder is not necessary to the method of this invention and the temperature will therefore be maintained as nearly constant as possible as the copolymer passes through the extruder except that the temperature in the inlet zone, i.e., the zone or zones where the feed materials are introduced may, generally, be maintained somewhat below the reaction zone temperature to maximize the mixing of the free radical initiator thereby improving grafting efficiency.

If a diluent will be used, the copolymer will be combined with the suitable diluent first as the copolymer passes through the blending apparatus. Introduction of the diluent into the extruder before the N-vinylimidazole or the free radical initiator serves to reduce the amount of scission or degradation of the polymer that would otherwise occur as described in Gorman et al. U.S. Pat. No. 5,073,600, which is herein incorporated by reference.

As the copolymer feed and optional diluent continue through the extruder, they are next contacted either with the N-vinylimidazole or a free radical initiator. Addition of the N-vinylimidazole prior to addition of the free radical initiator is preferred since it has been discovered by Gorman et al. that prior addition of the free radical initiator will, generally, result in an increased amount of crosslinked or coupled polymer in the product recovered from the blending apparatus. N-vinylimidazole can be fed to the blending apparatus as a liquid or as a solution in a suitable solvent. The temperature in the blending apparatus at the point at which the N-vinylimidizole is introduced is not critical to the product of the present invention. For reasons more fully explained below, the polymer will, preferably, be at a temperature below about 210° C. when the N-vinylimidazole is introduced.

As the polymer, optional diluent, and the N-vinylimidazole continue to move through the blending apparatus, the blend is next contacted with a free radical initiator. The free radical initiator may be fed to the blending apparatus neat or as a solution. Most of the free radical initiators contemplated for use in the method of the present invention are normally liquid and will, generally, be introduced into the extruder in this state. As is well known in the prior art, free radical initiators such as those contemplated for use herein generally have a very short half life at elevated temperatures and frequently even decompose at temperatures within the range of those contemplated for use herein. As a result, it is important to introduce the free radical initiator into the blending apparatus at as low a temperature as reasonably practicable and then relatively quickly thereafter bring the temperature of the entire blend up to the desired reaction temperature so as to insure maximum efficiency during the grafting reaction. In this regard, maximum reaction efficiency is generally realized when the temperature of the blend with which the free radical initiator is initially contacted is within the range from about 160° C. to about 210° C. As a result, and as indicated supra, the initial stages of the blending apparatus will be maintained at a temperature within this range so as to insure maximum reaction efficiency. The temperature will, however, be raised to the desired reaction temperature as quickly after the free radical initiator is added as is practicable.

The effluent from the reaction zone will contain unreacted N-vinylimidazole when the grafting reaction does not proceed to completion. Because the N-vinylimidazole may be detrimental to a lubricating oil viscosity index improver if allowed to remain in the polymer product in an ungrafted state, at least a portion of the unreacted compound should be separated from the polymer product prior to use. Any of the conventional techniques known in the prior art such as stripping, extraction, and the like may be used. Frequently, however, a portion of the unreacted N-vinylimidazole may be separated from the graft reaction zone effluent simply by vacuum venting the effluent after the grafting reaction is completed. The vapor will contain, in addition to unreacted N-vinylimidazole, free radical initiator decomposition products formed as a result of degradation and the like. In general, vacuum venting of the grafting reactor effluent will remove from about 20 to about 80% of the unreacted N-vinylimidizole contained in the effluent. The temperature in the zone where the effluent is vented could, of course, be increased to increase the vapor pressure of the components to be vented.

The process of making the polymer of the present invention has the desirable feature of being operable in standard polymer handling equipment. Further, the residence time of the process is only about 15 seconds to about 3 minutes. This is a distinct advantage over prior art solution functionalization. The product of the present process therefore has a narrower molecular weight distribution than products of prior art solution functionalization methods. The narrower molecular weight distribution minimizes the rate of degradation of the polymer in lubricating oil service, and therefore maximizes the retention of the "thickening" effect of the polymer. This advantage is evidenced by lower shear loss or DIN (ASTM D-3945) loss. The product of the present process also has excellent viscosity index improving properties and excellent dispersant characteristics.

EXAMPLES

In Examples 1–4 a linear diblock copolymer was extruded in a Berstorff ZE-40A twin screw, corotating, fully intermeshing, fully self-wiping extruder at a rate of 80 lbs/hr. The copolymer used was a polystyrene—hydrogenated polyisoprene diblock copolymer containing about 37% wt polystyrene and having a total molecular weight of about 97,000. The polyisoprene block was hydrogenated to remove greater than 98% of its original ethylenic unsaturation. This is referred to as Polymer A.

Example 1

The block copolymer was fed into the extruder and conveyed at 80 lbs/hr. The first injector port was used to inject a mixture of 67.5% wt N-vinylimidazole (NVI) and 32.5% wt acetone at a rate of 13.6 ml/min. The second injector port was used to inject the peroxide, 2,5-dimethyl-2,5-di(t-butylperoxy)hexane, 25% wt in Penrico oil, at a rate of 240 ml/hr. The copolymer melt then passed a vacuum port operated at a pressure of 26 inches of water prior to exiting the die plate and being underwater pelletized, dewatered, spin dried, and packaged. The copolymer in this example contained 2400 ppm of nitrogen which was bound to the polymer.

Example 2

This example was run as Example #1 but with the following feed rates: polymer 80 lbs/hr, NVI/acetone 5.4 ml/min, peroxide/oil 240 ml/hr. The Example 2 polymer had a bound nitrogen content of 900 ppm.

Example 3

This example was run as Example 1 but with the following feed rates: polymer 80 lbs/hr, NVI/acetone 13.6 ml/min, peroxide (t-amylperoxide)/oil 240 ml/hr. The Example 3 polymer had a bound nitrogen content of 1900 ppm.

Example 4

This example was run as Example 1 but with the following feed rates: polymer 80 lbs/hr, NVI/acetone 23.6 ml/min, peroxide (t-amylperoxide)/oil at 400 ml/hr. The Example 4 polymer had a bound nitrogen content of 4700 ppm.

The polymers from Examples 1–4 as well as the ungrafted diblock copolymer precursor were blended to SAE 15W-40 fully formulated engine oils for testing. The formulation for these oils was the following.

| Ingredient | Conc, % wt | Conc, % wt | Supplier |
|---|---|---|---|
| Shell 100N Oil | 44.8 | 45.0 | Shell |
| Shell 250N Oil | 39.0 | 39.0 | Shell |
| ECA 11039 | 0.2 | 0.2 | Exxon |
| AC-60-C | 0.5 | 0.5 | Shell |
| HITEC 1230 | 14.4 | 14.4 | Ethyl |
| NVI-grafted DVII | 1.1 | | |
| Non-grafted VII | | 0.9 | |

ECA 11039 is a polymethacrylate type pour point depressant. AC-60-C is an overbased calcium salicylate type detergent. HITEC 1230 is a proprietary DI package.

Rheological properties were tested with the following industry standard tests. KV is the kinematic viscosity, in centistokes (cSt), at 100° C. measured by ASTM D445. CCS is the Cold Cranking Simulator high shear viscosity, in centipoise (cP), measured by ASTM D5293 at the low temperature specified for the particular grade of the oil. MRV is the Mini-Rotary Viscometer low temperature, low shear viscosity, in cP, measured by ASTM D4684. The Orban Test measures the permanent loss of KV when the oil is sheared in a diesel injector rig according to ASTM D3945.

Results of these rheological measurements are given in Table 1. Results show that all four of the NVI-grafted polymers give good 15W/40 oils. All five oils were thickened to a KV of about 14.3cSt. At the same KV, all four of the NVI-grafted polymers give better low temperature viscosities but they give slightly more shear degradation in the Orban Test.

An industry standard engine test to measure roller-follower wear, the General Motors 6.2L test, was run on oils containing each of the five polymers. Results given in Table 1 show that all four of the NVI-grafted polymers gives oils which show less wear than the oil based on the unfunctionalized VII.

Thus, all of the NVI-grafted polymers give better low temperature Theological properties and less engine wear than the ungrafted polymer. Example 4 had quite a high nitrogen incorporation relative to examples 1–3 and is disfavored due to the expense of doing this.

TABLE 1

| Example | KV cSt | CCS cP | MRV −20° C. cP | MRV −25° C. cP | Orbahn Test % KV Loss | GM 6.2L Wear Test (Mils) | Nitrogen Content ppm |
|---|---|---|---|---|---|---|---|
| 1 | 14.2 | 3060 | 10,227 | 29,623 | 8.6 | 0.23 | 2400 |
| 2 | 14.2 | 3170 | 11,087 | 28,880 | 7.6 | 0.24 | 900 |
| 3 | 14.3 | 3150 | 11,612 | 27,393 | 5.9 | 0.30 | 1900 |
| 4 | 14.4 | 3170 | 11,920 | 25,541 | — | 0.25 | 4700 |
| Ungrafted Polymer | 14.4 | 3380 | 13,173 | 31,063 | 4.7 | 0.34 | 0 |

Examples 5 and 6 used a polymer feed composed of the same polystyrene/hydrogenated polyisoprene diblock Polymer A and a cofeed of another polystyrene/hydrogenated polyisoprene diblock copolymer that contained about 10% wt tapered polystyrene and that had a molecular weight of 225,000. This second polymer is referred to as Polymer B.

Example 5

This polymer was prepared by the same method and at the same feed rates as Example 1 but with a polymer blend of 75% wt Polymer A and 25% wt Polymer B. This Example 5 polymer had a bound nitrogen content of 1950 ppm.

Example 6

This polymer was prepared by the same method and at the same feed rates as Example 5 but with a blend of 90% wt Polymer A and 10% wt Polymer B. This Example 6 polymer had a bound nitrogen content of 1250 ppm.

Examples 7 and 8 used a polymer feed composed of the same polystyrene/hydrogenated polyisoprene diblock Polymer A and a cofeed of a radial polystyrene/hydrogenated polyisoprene polymer, referred to as Polymer C. The arms on Polymer C were polystyrene/hydrogenated polyisoprene diblock polymers containing about 6% wt polystyrene and having a total molecular weight of each arm of about 55,000. About 20 of these diblock arms were coupled together to form Polymer C.

Example 7

This polymer was prepared by the same method as Example 1 but with a polymer blend of 75% wt of Polymer A and 25% w of Polymer C and injecting neat NVI at a rate of 9.1 ml/min. This Example 7 polymer had a bound nitrogen content of 1910 ppm.

Example 8

This polymer was prepared by the same method and at the same injection rates as Example 7 except with a polymer blend of 60% wt Polymer A and 40% w of Polymer C. This Example 8 polymer had a bound nitrogen content of 1850 ppm.

Example 9

Use of a dispersant VII should allow preparation of motor oils containing less of the ashless dispersant than is required in oils containing a non-dispersant VII. This example demonstrates that, when replacing Polymer A with the NVI-grafted version of Polymer A from Example 1, at least 40% wt of the ashless dispersant required for use with Polymer A can be removed from the motor oil formulation and still maintain acceptable engine cleanliness.

The motor oil formulation for this experiment used Chevron 100N and 240N base oils and a proprietary DI package from Ethyl containing the same additives normally used to make satisfactory motor oils with Polymer A except containing 40% wt less ashless dispersant. A 10W40 motor oil was formulated using 1.1% wt of the DVII from Example 1, the DI package containing the reduced level of ashless dispersant and the two base oils at the correct ratio to meet the 10W specification. The ability of this oil to satisfy the engine cleanliness requirements was tested in the Sequence VE engine test for sludge, varnish and wear. The following results were obtained.

Sequence VE Test Results

| Test Item | Result | Pass/Fail Spec |
|---|---|---|
| Average engine sludge | 9.34 | P/F 9.0 min |
| Rocker Arm Cover Sludge | 8.42 | P/F 7.0 min |
| Average Engine Varnish | 5.82 | P/F 5.0 min |
| Piston Skirt Varnish | 6.54 | P/F 6.5 min |
| Average Cam Wear (micrometers) | 17 | P/F 130 max |
| Maximum Cam Wear (micrometers) | 28 | P/F 380 max |

The composition of the present invention achieved an average engine sludge rating of 9.34 wherein the pass/fail minimum was 9.0 for the test. Similarly, the composition of the present invention exceeded the minimums for the rocker arm cover sludge, average engine varnish, and piston skirt varnish aspects of the test. The average cam wear and maximum cam wear aspects of the test were passed by a wide margin. These results demonstrate that in oils containing a DVII as described in this invention, at least 40% wt less ashless dispersant is required to meet engine cleanliness performance than is required in oils using a non-dispersant VII.

Example 10

The reduction in ashless dispersant which is allowed by use of the DVII of the present invention not only brings an economic advantage by reducing the cost for ashless dispersant, but it also provides for improved fuel economy, in the inventive formulations. To demonstrate that the reduction in ashless dispersant brings an improvement in fuel economy, another formulation was prepared like Example 7 except the base oil ratio was adjusted to give a 5W30 oil. That is, it contained 1.1% wt of the DVII from Example 1 and the same amount of the proprietary DI package that is normally required for use with the non-dispersant VII Polymer A except containing 40% wt less of the ashless dispersant. Fuel economy was measured using the industry standard Sequence VIA test.

In the Sequence VIA test, the test sample is measured against a standard reference oil and the Effective Fuel Economy Improvement (EFEI) is measured. The table below shows the standard minimum requirement for SAE 10W30, 5W30, and 0W20 oils as well as the two tests which were performed on 5W30 oils using the dispersant VII block copolymer of the present invention.

Sequence VIA Results

| | |
|---|---|
| SAE 10W-30 oils | 0.5% EFEI (min standard) |
| SAE 5W-30 oils | 1.1% EFEI (min standard) |
| SAE 0W-20 oils | 1.4% EFEI (min standard) |
| Invention 5W-30 | 1.42% EFEI (actual) |
| Repeat Invention 5W-30 | 1.51% EFEI (actual) |

The first three rows in the table show the standards in increasing level of performance. In other words, the lowest level of performance is for 10W-30 oils, then 5W-30 oils, and finally 0W-20 oils. It can be seen from reviewing the test results in the fourth and fifth rows of the table that the composition of the present invention exceeded the standard for fuel economy for the equivalent 5W-30 oils and also exceeded the standard fuel economy test at the next highest level of performance (for 0W-20 oils). These results show that the reduction in ashless dispersant allowed by the use of the DVII of the present invention does indeed provide the additional advantage of improved fuel economy.

The use of the inventive DVII allows the formulator to reduce the normal ashless dispersant treat rate by at least about forty percent. The reduction in ashless dispersant content, provided by the inventive DVII, allows for the use of more base stock of lower volatility. This is increasingly important as engine oils of reduced volatility are important to protect the engines catalytic converter, leading to lower emissions into the environment. Further these same formulations, using the inventive DVII, provide for formulations with greatly increased fuel economy, as a result of lower ashless dispersant contents in the formulations. Finally, it is known by those skilled in the art that not all DVII polymers impart all of these benefits to the formulated engine oil.

I claim:

1. A lubricating oil composition comprising:

(a) from 0.01 to 10 percent by weight of a dispersant viscosity index improver linear diblock copolymer or mixture of diblock copolymers having an overall number average molecular weight of 7500 to 250,000 and comprising a block of a polyisoprene having a number average molecular weight of 5000 to 200,000 and a block of a vinyl aromatic hydrocarbon having a number average molecular weight of 2500 to 100,000, and a vinyl aromatic hydrocarbon content of 5 to 50 weight percent, wherein from 5 to 10 N-vinyl imidazole functional groups per polymer chain have been grafted onto the copolymer;

(b) from 5 to 20 percent by weight of a dispersant inhibitor package comprising an ashless dispersant; and (c) from 80 to 95 percent by weight of a base oil, wherein the amount of said ashless dispersant in said component (b) is at least 40 percent less than that which would have been present if said component (a) contained fewer than 5 grafted N-vinyl imidazole functional groups per polymer chain.

2. The composition of claim 1 wherein the copolymer has an average of 7 to 8 N-vinyl imidazole functional groups per polymer chain grafted thereon.

3. The composition of claim 1 wherein the diene is isoprene and the vinyl aromatic hydrocarbon is styrene.

4. The composition of claim 3 wherein the overall molecular weight is from 70,000 to 130,000, the polyisoprene block molecular weight is from 40,000 to 80,000, the polystyrene block molecular weight is from 20,000 to 50,000, and the polystyrene content is from 20% wt to 40% wt.

5. The composition of claim 1 wherein the copolymer comprises from 0.1 to 8.0% wt of the composition.

6. The composition of claim 5 wherein the copolymer comprises from 0.1 to 3.0% wt of the composition.

7. The composition of claim 1 wherein a portion of the total block copolymer is a radial or star block copolymer wherein each arm thereof has an overall number average molecular weight of 7500 to 250,000 and comprising a block of a conjugated diene having a number average molecular weight of 5000 to 200,000 and a block of a vinyl aromatic hydrocarbon having a number average molecular weight of 2500 to 100,000, and a vinyl aromatic hydrocarbon content of 5 to 50 weight percent, wherein from 5 to 10 N-vinyl imidazole functional groups per polymer chain have been grafted onto the copolymer.

8. A lubricating oil composition comprising:

(a) from 0.01 to 10 percent by weight of a dispersant viscosity index improver radial or star block copolymer wherein each arm thereof has an overall number average molecular weight of 7500 to 250,000 and comprising a block of a polyisoprene having a number average molecular weight of 5000 to 200,000 and a block of a vinyl aromatic hydrocarbon having a number average molecular weight of 2500 to 100,000, and a vinyl aromatic hydrocarbon content of 5 to 50 weight percent, wherein from 5 to 10 N-vinyl imidazole functional groups per polymer chain have been grafted onto the copolymer;

(b) from 5 to 20 percent by weight of a dispersant inhibitor package comprising an ashless dispersant; and (c) from 80 to 95 percent by weight of a base oils wherein the amount of said ashless dispersant in said component (b) is at least 40 percent less than that which would have been present if said component (a) contained fewer than 5 grafted N-vinyl imidazole functional groups per polymer chain.

9. The composition of claim 8 wherein the copolymer has an average of 7 to 8 N-vinyl imidazole functional groups per polymer chain grafted thereon.

10. The composition of claim 8 wherein the diene is isoprene and the vinyl aromatic hydrocarbon is styrene.

11. The composition of claim 10 wherein the overall arm molecular weight is from 70,000 to 130,000, the polyisoprene block molecular weight is from 40,000 to 80,000, the polystyrene block molecular weight is from 20,000 to 50,000, and the polystyrene content is from 20% wt to 40% wt.

12. The composition of claim 8 wherein the copolymer comprises from 0.1 to 8.0% wt of the composition.

13. The composition of claim 12 wherein the copolymer comprises from 0.1 to 3.0% wt of the composition.

14. A dispersant viscosity index improver linear diblock copolymer having an overall number average molecular weight of 7500 to 250,000 and comprising a block of a polyisoprene having a number average molecular weight of 5000 to 200,000 and a block of a vinyl aromatic hydrocarbon having a number average molecular weight of 2500 to 100,000, and a polystyrene content of 5 to 50 weight percent, wherein from 5 to 10 N-vinyl imidazole functional groups per polymer chain have been grafted to the copolymer.

15. The copolymer of claim 14 wherein the copolymer has an average of 7 to 8 N-vinyl imidazole functional groups per polymer chain grafted thereon.

16. The copolymer of claim 14 wherein the diene is isoprene and the vinyl aromatic hydrocarbon is styrene.

17. The copolymer of claim 16 wherein the overall molecular weight is from 70,000 to 130,000, the polyisoprene block molecular weight is from 40,000 to 80,000, the polystyrene block molecular weight is from 20,000 to 50,000, and the polystyrene content is from 20% wt to 40% wt.

18. A dispersant viscosity index improver radial or star block copolymer wherein each arm has an overall number average molecular weight of 7500 to 250,000 and comprising a block of a polyisoprene having a number average molecular weight of 5000 to 200,000 and a block of a vinyl aromatic hydrocarbon having a number average molecular weight of 2500 to 100,000, and a polystyrene content of 5 to 50 weight percent, wherein from 5 to 10 N-vinyl imidazole functional groups per polymer chain have been grafted to the copolymer.

19. The copolymer of claim 18 wherein the copolymer has an average of 7 to 8 N-vinyl imidazole functional groups per polymer chain grafted thereon.

20. The copolymer of claim 18 wherein the diene is isoprene and the vinyl aromatic hydrocarbon is styrene.

21. The copolymer of claim 20 wherein the overall arm molecular weight is from 70,000 to 130,000, the polyisoprene block molecular weight is from 40,000 to 80,000, the polystyrene block molecular weight is from 20,000 to 50,000, and the polystyrene content is from 20% wt to 40% wt.

22. A blend of at least two different linear diblock copolymers of claim 14.

23. A blend of at least one diblock copolymer of claim 14 and at least one radial or star block copolymer wherein each arm has an overall number average molecular weight of 7500 to 250,000 and comprising a block of a polyisoprene having a number average molecular weight of 5000 to 200,000 and a block of a vinyl aromatic hydrocarbon having a number average molecular weight of 2500 to 100,000, and a polystyrene content of 5 to 50 weight percent, wherein from 5 to 10 N-vinyl imidazole functional groups per polymer chain have been grafted to the copolymer.

24. A process for producing a dispersant viscosity index improver comprising grafting N-vinylimidazole to a linear diblock copolymer or mixture of diblock copolymers having an overall number average molecular weight of 7500 to 250,000 and comprising a block of a polyisoprene having a number average molecular weight of 5000 to 200,000 and a block of a vinyl aromatic hydrocarbon having a number average molecular weight of 2500 to 100,000, and a vinyl aromatic hydrocarbon content of 5 to 50 weight percent, or radial or star block copolymers, each arm thereof having an overall number average molecular weight of 7500 to 250,000 and comprising a block of a polyisoprene having a number average molecular weight of 5000 to 200,000 and a block of a vinyl aromatic hydrocarbon having a number average molecular weight of 2500 to 100,000, and a vinyl aromatic hydrocarbon content of 5 to 50 weight percent, or mixtures of said copolymers, wherein the grafting functionalization is performed in a device capable of imparting high mechanical energy, is performed in the presence of between 0% and about 15% by weight based on the amount of ungrafted copolymer of a diluent oil, and sufficient N-vinylimidazole is used so that from 5 to 10 N-vinyl imidazole functional groups per polymer chain are grafted onto the copolymer and wherein the residence time in said device is from about 15 seconds to about 3 minutes.

25. The process of claim 24 wherein the device capable of imparting high mechanical energy is selected from the group consisting of Banbury mixer, and sigma blade mixer.

26. The process of claim 24 wherein the functionalization is performed in the presence of from about 0.05 to about 0.50wt % based on polymer of a free radical initiator.

27. The process of claim 26 wherein the free radical initiator is selected from the group consisting of benzoyl peroxide, t-butyl peroxypivalate, 2,4-dichlorobenzoyl peroxide, decanoylperoxide, propionyl peroxide, hydroxyheptyl peroxide, cyclohexanone peroxide, t-butylperbenzoate, dicumyl peroxide, lauroyl peroxide, t-butyl hydroperoxide, 2,2-azobis(2-methylpropionitrile), 2,2-azobis(2-methylvaleronitrile), 4,4'-azobis(4-cyanovaleric acid), di-t-butylperoxide, 1,1-bis(t-butylperoxy)-3,3,5-trimethylcyclohexane, t-butylcumylperoxide, and 2,5-dimethyl-2,5-di(t-butylperoxy)hexane.

28. The process of claim 24 wherein the device capable of imparting high mechanical energy is an extruder.

* * * * *